US006681505B1

(12) United States Patent
Wells

(10) Patent No.: US 6,681,505 B1
(45) Date of Patent: Jan. 27, 2004

(54) SNOW PLOW BARRIER ATTACHMENT

(76) Inventor: John Wells, 14104 N. Green Bay Rd., Mequon, WI (US) 53097

( * ) Notice: Subject to any disclaimer, the term of this patent is extended or adjusted under 35 U.S.C. 154(b) by 0 days.

(21) Appl. No.: 10/219,778

(22) Filed: Aug. 15, 2002

Related U.S. Application Data

(60) Provisional application No. 60/312,859, filed on Aug. 16, 2001.

(51) Int. Cl.[7] ..... E02F 3/96; E01H 5/06

(52) U.S. Cl. ..... 37/281; 37/280; 37/274; 37/903; 172/509

(58) Field of Search ..... 37/219, 196, 266, 37/274, 275, 281, 280, 903; 172/509

(56) References Cited

U.S. PATENT DOCUMENTS

| | | | | | |
|---|---|---|---|---|---|
| 1,926,011 | A | * | 9/1933 | Soule | 37/275 |
| 2,763,944 | A | * | 9/1956 | Magee et al. | 172/815 |
| 2,964,862 | A | * | 12/1960 | Lotz | 37/280 |
| 3,055,126 | A | | 9/1962 | Emhof | |
| 3,208,166 | A | | 9/1965 | Proulx | |
| 3,407,519 | A | * | 10/1968 | Batko | 37/280 |
| 4,145,825 | A | * | 3/1979 | Bertolino | 37/280 |
| 4,208,812 | A | | 6/1980 | Brownly | |
| 4,217,707 | A | | 8/1980 | Karlsson | |
| 4,346,928 | A | * | 8/1982 | Towsend | 294/51 |
| 4,459,769 | A | * | 7/1984 | Willis, Sr. | 37/275 |
| 4,607,872 | A | * | 8/1986 | Herner | 294/54.5 |
| 4,833,799 | A | * | 5/1989 | Harte et al. | 37/231 |
| 5,048,207 | A | * | 9/1991 | Verseef | 37/281 |
| 5,155,929 | A | | 10/1992 | Vachon | |
| 5,185,946 | A | * | 2/1993 | Farrell | 37/231 |
| 5,265,356 | A | | 11/1993 | Winter | |
| 5,375,349 | A | | 12/1994 | Jochim | |
| 5,477,600 | A | * | 12/1995 | Houle et al. | 37/279 |
| 5,758,728 | A | | 6/1998 | Ragule | |
| 5,815,957 | A | | 10/1998 | McKeown | |
| 5,894,689 | A | * | 4/1999 | Turk | 37/281 |
| 5,903,986 | A | * | 5/1999 | Parker | 37/281 |
| 5,921,326 | A | | 7/1999 | Ragule | |
| 6,240,660 | B1 | | 6/2001 | Dugas | |

* cited by examiner

*Primary Examiner*—Robert E. Pezzuto
*Assistant Examiner*—Thomas A. Beach
(74) *Attorney, Agent, or Firm*—Boyle Fredrickson Newholm Stein & Gratz S.C.

(57) ABSTRACT

A snow plow blade includes a selectively extendable barrier attachment. The barrier attachment includes a base pivotally secured to the plow blade and secured to one end of each of a number of flexible members that are also engaged by a retraction mechanism for the barrier attachment that is disposed on the blade. The retraction mechanism is used to automatically retract and extend the flexible members as the base is pivoted between a retracted position and a deployed position on the blade. In the deployed position, the flexible members form a wall that prevents snow collected or diverted by the plow blade from passing through the barrier attachment. The barrier attachment may also include a separate deployment mechanism that operates to move the base between the retracted and deployed positions, and a brace used to hold the barrier attachment in position when in the deployed position.

39 Claims, 6 Drawing Sheets

SNOW PLOW BARRIER ATTACHMENT

CROSS REFERENCE TO RELATED APPLICATIONS

This application claims priority under 35 U.S.C. §119(e) to U.S. Provisional Patent Application No. 60/312,859, filed Aug. 16, 2001, which is hereby incorporated herein.

FIELD OF THE INVENTION

The invention relates generally to snowplow blades attached to a vehicle and used in plowing snow in a precise manner. More specifically, the invention relates to a compact extendable and retractable barrier attachment for a snow plow blade used in precise plowing operations and having a number of flexible barrier members.

BACKGROUND OF THE INVENTION

In general, snowplows are designed for rigorous and demanding use in removing snow over varying surfaces ranging from gravel roads to concrete freeways. Among the various uses of snowplows, municipal services and private plow services stand out as two of the most common applications for snow plows. In these applications, the largest concern is the small amount of available space for placing and/or retaining the snow collected by the plow. The limited space results in a situation where snow collected by the plow is often deposited across roadways, driveways, and sidewalks. Accordingly, because of the limited space available for retaining snow removed from congested city streets and landscaped private drives, snowplow operations require precise control over the flow of snow in order to unnecessarily prevent plowed snow from blocking city streets, public and private driveways and the like. Several snow removal assemblies for better controlling the removal and placement of snow are embodied in the related art.

For example, a plow with a deflector assembly that is supported to extend over the top edge of the snow plow and which deflects snow from flying into the windshield of the vehicle and obstructing the view of the driver is disclosed in Vachon U.S. Pat. No. 5,155,929. Similarly, Winter U.S. Pat. No. 5,265,356 embodies a hydraulic system for better controlling blade direction, which allows for better ice scraping and prevents blade damage. Indeed, innumerable applications arise concerning snowplowing and the unique problems such an endeavor presents.

However, none of the prior attempts at designing a snow plow system for precisely removing snow provides a system in which the snowplow includes an attachment that is capable of substantially preventing the entire discharge of snow from the plow in order to perform very precise snow removal. Further, it would be desirable if such a system were also movable in order to allow the plow to divert the snow to a desired location in a highly efficient manner and utilizing a structure that is simple in construction and easy to maintain.

SUMMARY OF THE INVENTION

The present invention is a snow plow barrier attachment for a snow plow blade having an overall conventional construction that form retractable snow guides or barriers that can be deployed from the blade to selectively prevent the plow from diverting the snow being collected and/or removed by the snow plow in a desired manner. The barriers include a rigid base pivotally secured to the plow blade and a number of flexible members, such as straps, chains and cables, that are spaced from one another and extend across the base to form a semi-solid, flexible wall on the base. At the opposite end, the flexible members can be connected to a support member, or to a rewind mechanism disposed on the rear of the snow plow.

In order to deploy the barrier on the plow blade, the base is moved from a retracted position to an extended position using a deployment mechanism located on the plow blade. The deployment mechanism can be the rewind mechanism for the straps, a hydraulic ram operably connected to the base, or any other suitable mechanism. When the barrier is moved to the outward, extended position, a brace attached between the base and the plow blade operates to hold the barrier in the extended position when in use by limiting the pivoting movement of the barrier with respect to the snowplow blade.

When the barrier is in the deployed position, snow collected from a roadway or other surface by the snow plow blade contacts the barrier and is prevented from being discharged from the side of the plow. The resiliency of the flexible members on the barrier allows the snow contacting the flexible members to be urged back in front of the plow blade to be moved further along the roadway by the plow without being diverted by the plow to an undesired location, such as across a driveway or roadway. When the plow or barriers are not in use, i.e., when it is desired to dispense snow away from the plow blade, the pivotal attachment of the base to the plow blade allows the barriers to be pivoted from their extended position on the front of the snowplow into a retracted position so that snow can be deposited to the side of the plow.

The barrier attachments also include various accessories attached to the base, brace and flexible members that enable the barriers to withstand the shock normally associated with plowing operations without damaging any part of the attachments.

Numerous alternative embodiments and other aspects of the invention will be made apparent from the following detailed description taken together with the drawings.

BRIEF DESCRIPTION OF THE DRAWINGS

The drawings illustrate the best mode currently contemplated of practicing the present invention.

In the drawings.

Figure 1:
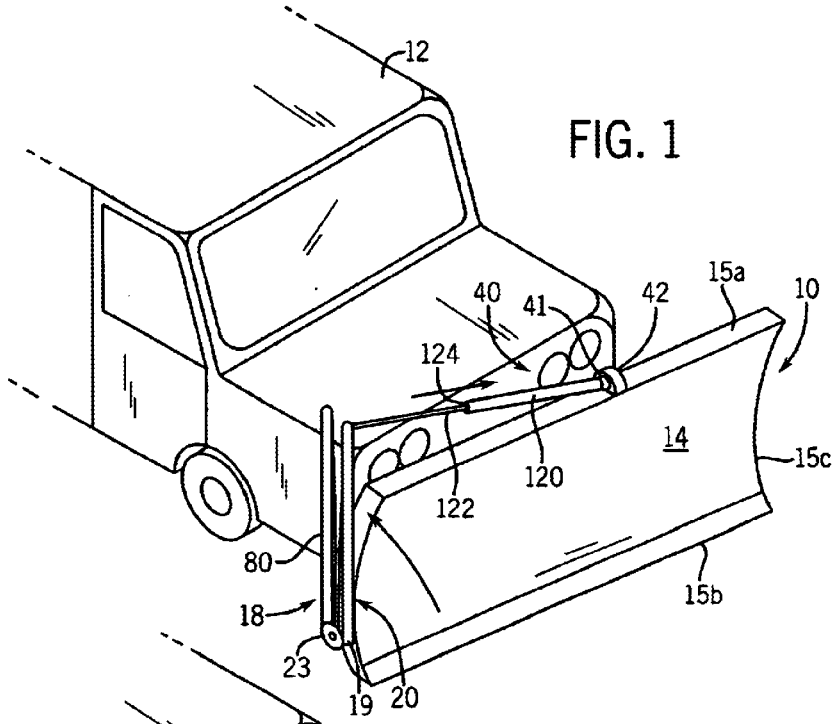
FIG. 1 is an isometric view of a conventional snow plow blade secured to a vehicle including a barrier attachment constructed according to the present invention on the blade in a retracted position.

Before explaining embodiments invention in detail, it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION

Referring now to the drawings, in which like reference numerals designate like numerals throughout the disclosure, a conventional snow plow blade used in the present invention is shown generally at 10 in FIG. 1. The plow blade 10 is attached to a vehicle 12 in a conventional manner such that the vehicle 12 can transport and operate the plow 10 in order to remove snow or other debris from a street or driveway as necessary. The plow 10 is generally curved or concave in shape and includes a front surface 14 positioned opposite the vehicle 12 and a rear surface 16 which is attached to the vehicle 12 by a conventional plow hydraulic hitch attachment mechanism 17 that allows an operator seated in the vehicle 12 to adjust the position of the plow blade 10 with respect to the vehicle 12. The plow 10 also defines a top end 15*a*, a bottom end 15*b* and a pair of opposed sides 15*c*.

Figure 2:
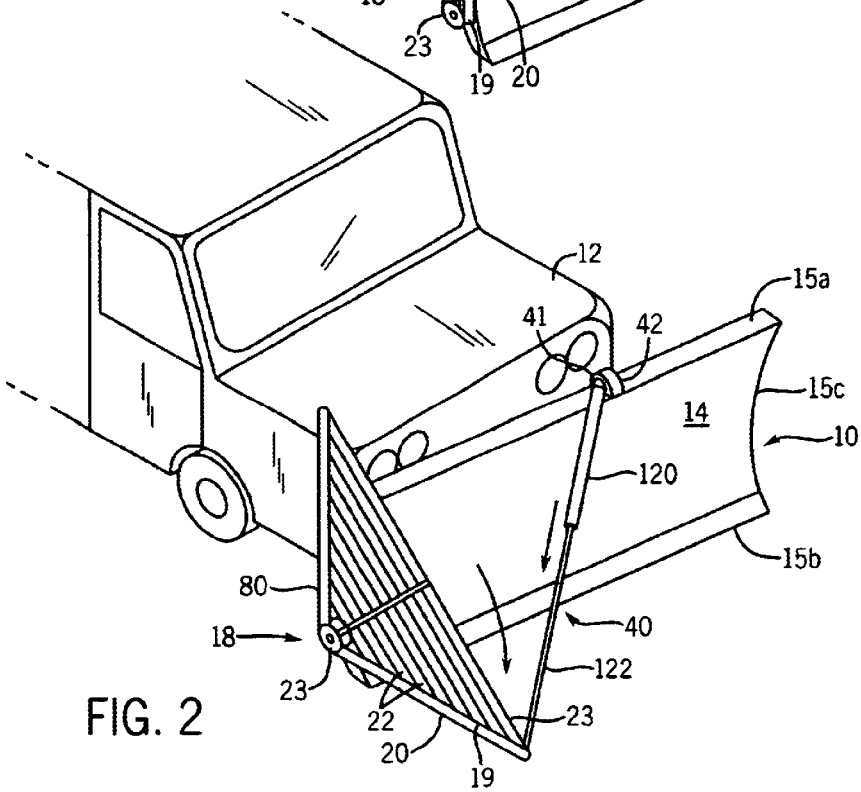
FIG. 2 is an isometric view of the plow of FIG. 1 showing the barrier attachment in a deployed position.

Referring now to FIGS. 1 and 2, a movable barrier attachment 18 is illustrated extending outwardly from the front surface 14 of the plow 10. When the barrier 18 is in the retracted position shown in FIG. 1, the barrier 18 is oriented vertically and generally parallel to the blade 10. In the deployed position shown in FIG. 2, the barrier 18 is positioned generally perpendicular to the front surface 14 of the plow 10 and is supported on the plow 10 to prevent the diversion of snow caught by the plow 10 without inducing instability to the plow 10 or to the barrier 18.

Referring to FIGS. 1–7, the barrier 18 includes a base 20 that is pivotally mounted to the plow 10 at the bottom end 15*b* of the plow 10. The base 20 includes a bar 19 secured between a pair of flanges 21 that each have a shaft opening 103. The base 20 is formed of a rigid material, such as a metal, and is pivotally movable from an extended position, where the base 20 extends outwardly generally perpendicular to the front surface 14 of the plow 10 shown in FIG. 1, to a retracted position where the base 20 is positioned vertically in general alignment with the front surface 14 of the plow 10. Preferably, the base 20 is connected to the plow blade 10 by a shaft 100 rotatably secured to the rear surface 16 of the plow blade 10, best shown in FIGS. 5–7. The shaft 100 is rotatably retained on the plow blade 10 by a number of bearing brackets 102 that are secured to the rear surface 16 of the plow blade 10 and allows the shaft 100 to rotate therein. The base 20 is fixed to the shaft 100 opposite the bracket 102 by the insertion of the shaft 100 into the shaft openings 103 in the flanges 23 of the base 20 so that the base 20 rotates with the shaft 100 between the deployed and retracted positions.

The base 20 in conjunction is also connected to one end of each of a plurality of flexible members 22 along the length of the arm 19 of the base 20 in a conventional manner. The flexible members 22 can be straps, cables or chains that are formed of rigid or semi-rigid materials depending on the form of the members 22, such as a metal, or reinforced rubber or nylon webbing, for example. Each of the flexible members 22 is spaced a small distance from each of the adjacent members 22 and extends away from the base 20 at an acute angle with respect to the base 20 towards the plow 10 to form a generally continuous, triangular-shaped wall 23 on the barrier 18. Opposite the base 20, each of the flexible members 22 is attached to a retraction mechanism 59 disposed on the plow 10 above the shaft 100 and bracket 102.

Figure 5:
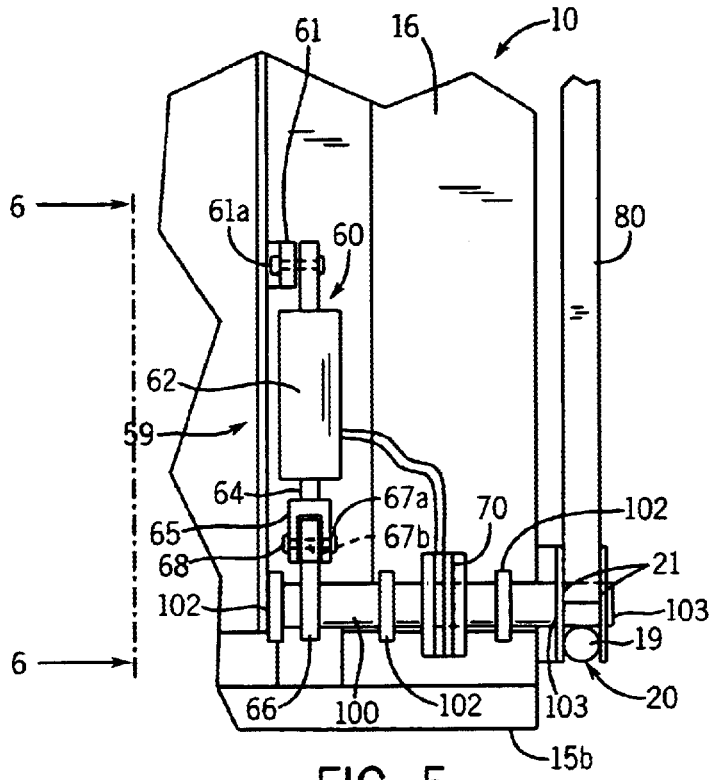
FIG. 5 is a cross-sectional view along line 5—5 of FIG. 3.
Figure 7:
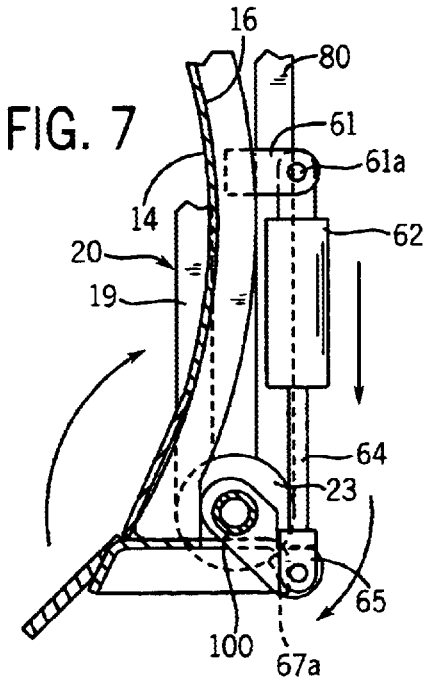
FIG. 7 is a partially broken away side plan view of the deployment mechanism of FIG. 5 moving the barrier attachment to the retracted position.
Figure 6:
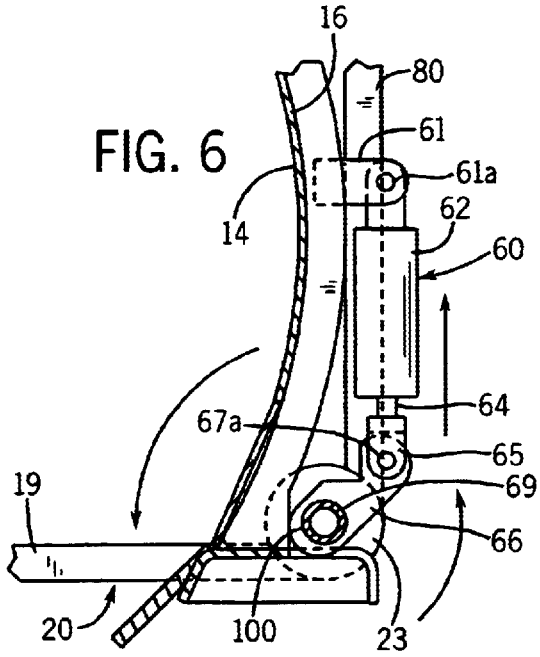
FIG. 6 is a partially broken away side plan view of the deployment mechanism of the barrier attachment of FIG. 5 moving the barrier attachment to the deployed position.

Referring now to FIGS. 5–7, the barrier 18 is shown including a deployment mechanism 58 and a separate retraction mechanism 59. In this embodiment, the base 20 of the barrier 18 is fixedly secured to the shaft 100 that is rotatably mounted within the bearing bracket 102 on the rear surface 16 of the plow 10. Opposite the base 20, the shaft 100 is connected to the deployment mechanism 59 which includes a hydraulic ram 60 fixedly secured to the rear surface 16 of the plow 10 by a bracket 61 and pin 61*a*, and is operably connected to the vehicle 12 through the plow hitch attachment mechanism 17. The ram 60 includes a housing 62 and an outwardly extending and retractable arm 64. The arm 64 is pivotally connected opposite the housing 62 to a pivot plate 66 using a clevis 65 and a bolt 68 inserted through aligned openings 67*a* and 67*b* in the clevis 65 and plate 66, respectively. Opposite the arm 64, the plate 66 includes a shaft opening 69 positioned around and fixedly connected to the shaft 100.

Upon activation of the hydraulic ram 60, the arm 64 extends outwardly from the housing 62 to pivot the pivot plate 66 around the bolt 68. As the plate 66 moves due to the movement of the arm 64, the shaft 100 is rotated through a ninety (90) degree arc in order to raise the base 20 from the deployed position extending outwardly from the front surface 14 to a retracted position where the base 20 extends vertically in general alignment with the front surface 14 as shown in FIG. 7. Conversely, when the barrier 18 is in the retracted position, by retracting the arm 64 into the housing 62, the base 20 is pivoted downwardly to extend forwardly perpendicular to the front surface 14, placing the barrier 18 in the deployed position.

Preferably, the deployment mechanism 59 also includes a clutch 70 attached to the shaft 100 between the hydraulic ram 60 and the base 20 and fixed to the rear surface 16 of the plow blade 10. The clutch 70 operates to ensure that the hydraulic ram 60 is not damaged when the base 20 contacts an obstruction and is deflected upwardly from the extended or deployed position in opposition to the ram 60. When the base 20 contacts such an obstruction, the force exerted on the base 20 by the obstruction is transmitted from the base 20 through the shaft 100 to the clutch 70. If the amount of force transmitted to the clutch 70 over a specified set point, the clutch 70 will operate to disengage the arm 64 from the hydraulic pressure mechanism (not shown) disposed within the housing 62 such that the arm 64 can freely extend from within the housing 62 to avoid damage being done to the base 20, shaft 100, or hydraulic ram 60. When this force is removed, the clutch 70 allows the ram 60 to operate to retract the arm 64 into the housing 62.

Figure 3:
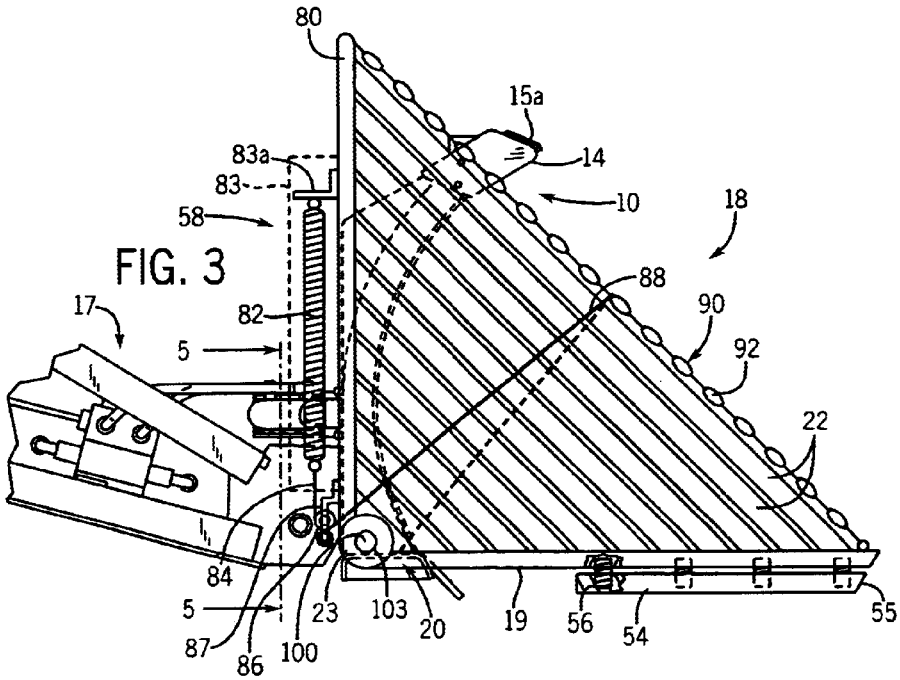
FIG. 3 is a side plan view of the snow barrier attachment of FIG. 1 in the deployed position.
Figure 4:
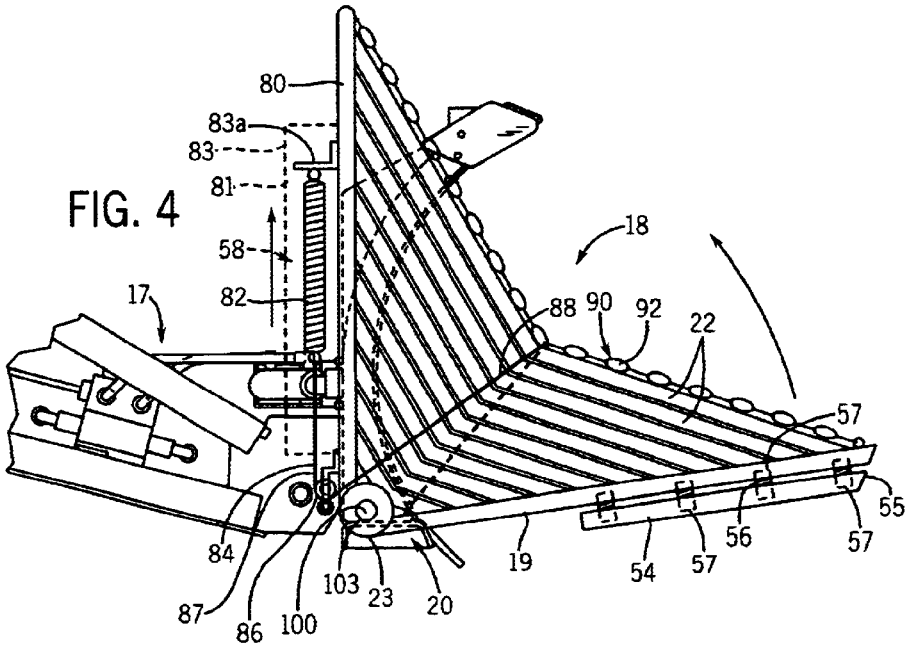
FIG. 4 is a side plan view of the snow barrier of FIG. 3 in partially retracted position.

Looking now at FIGS. 3 and 4, the retraction mechanism 59 includes an anchor tube 80 secured to one side 15*c* of the plow blade 10 in alignment with the base 20. The tube 80 includes a housing 83 opposite the blade 10 that is hollow, defining an interior 81 in which is disposed a spring 82 that is fixedly mounted to the top of the housing 83 by a bracket 83*a* disposed within the housing 83 adjacent the top end 15*a* of the plow blade 10. The spring 82 is attached opposite the housing 83 to one end of a cable 84 that extends downwardly through the interior 81 of the housing 83 and beneath a pulley 86 rotatably fixed to the housing 83 above the base 20. The pulley 86 can be fixed to the housing 83 by a bracket 87 that allows the free rotation of the pulley 86. Opposite the pulley 86, the cable 84 extends around all of the flexible members 22 and is secured to the base 20 to form a loop 88 which encircles all of the flexible members 22 which are fixedly secured between the anchor tube 80 and the base 20. When the barrier 18 is in the extended position shown in FIG. 3, the spring 82 is in a stretched and stressed position such that the bias of the spring 82 pulls inwardly on the cable 84, loop 88 and each of the flexible members 22. Thus, when the base 20 is pivoted to the vertical, retracted position, the spring 82 operates to retract the cable 84 within the housing 83 such that the loop 88 extending around each of the flexible members 22 is pulled downwardly and contracted towards the pulley 86. Consequently, as shown in FIG. 4, each of the flexible members 22 is pulled towards the pivot point of the base 20 and blade 10 in order to retract and position the flexible members 22 in a location where the members 22 will not interfere with the normal operation of the plow 10 while the barrier 18 is in the retracted position. When the base 20 is again extended to the deployed position, the movement of the base 20 to the extended position extends flexible members 22 against the bias of the spring 82, thereby withdrawing the loop 88 and cable 84 outwardly from the housing 83.

In order to assist the deployment mechanism 59 in the movement of the barrier attachment 18 to its extended position, and to provide added support for the barrier attachment 18 in the extended position, the barrier 18 can also include a brace 40 pivotally secured to the front surface 14 of the plow 10. The brace 40 is an elongate rod formed of a rigid material, such as a hard plastic or metal. The brace 40 includes a ball 41 rotatably retained within a socket 42 disposed on the plow 10 at the top end 15*a* of the front surface 14 and spaced horizontally from the attachment point for the base 20. The end of the brace 40 opposite the plow 10 also includes a ball (not shown) that is retained within a socket (not shown) disposed on the base 20 opposite the plow 10. Thus, the brace 40 can pivot at each end with respect to the plow 10 and the base 20 as the base 20 moves with respect to the plow 10.

In the embodiment shown in FIGS. 1 and 2, the brace 40 includes a housing 120 on which the ball 41 is disposed and a telescoping rod 122 slidably retained within an opening 124 opposite the ball 41. The ball on the brace 40 opposite the ball 41 is disposed on the end of the rod 122 spaced from the housing 120 and is pivotally engaged within the socket on the base 20. The movement of the rod 122 into and out of the housing 120 is opposed by a gas spring mechanism (not shown). When the barrier 18 is moved from the retracted position of FIG. 1 to the extended position of FIG. 2, the housing 120 pivots with respect to the socket 42 and the rod 122 pivots with respect to the base 20. Further, the rod 122 is extended from the housing 120 against the bias of the gas spring until the rod reaches the fully extended position when the barrier 18 is fully deployed. In this position, the brace 40 provides support to the base 20 and flexible members 22 against the force of the snow collected by the plow 10 that pushes against the barrier 18. Also, due to the bias of the gas spring against the retraction of the rod 122 into the housing 120, the brace 40 provides support to the barrier 18 against forces acting on the barrier 18 opposite the plow 10, such as in the situation where the barrier 18 strikes an object, such as a curb (not shown).

Figure 8:
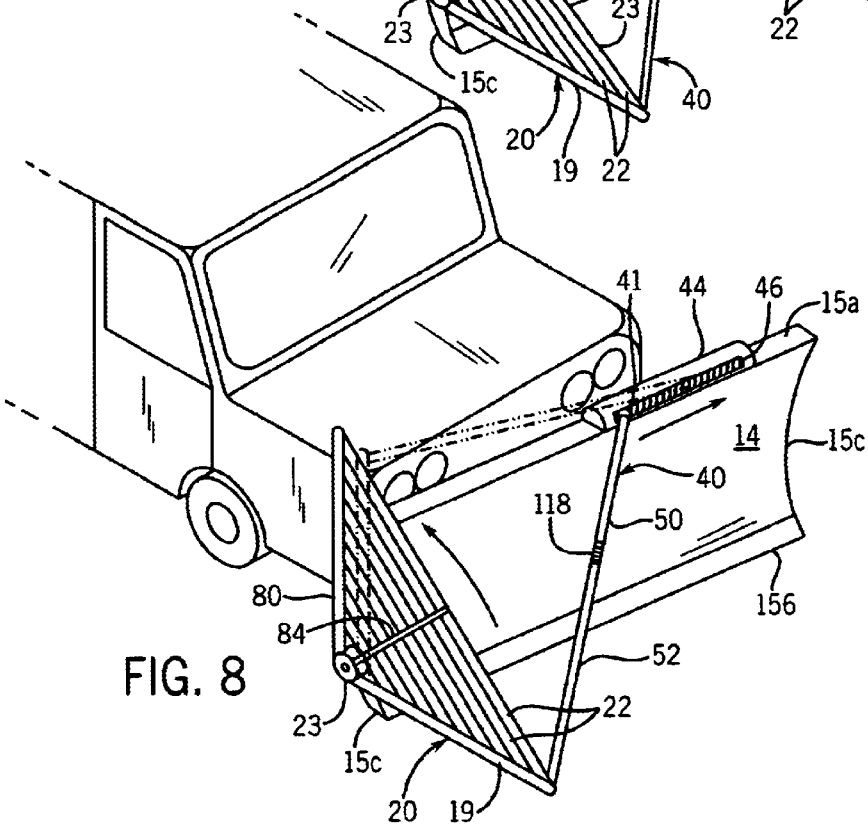
FIG. 8 is an isometric view of a second embodiment of the barrier attachment of FIG. 1.

Other configurations for the brace 40 can also be employed with the barrier attachment 18. In another particularly preferred embodiment that operates to prevent the pivoting movement of the barrier attachment 18 either towards or away from the plow blade 10 shown in FIG. 8, the ball 41 on the brace 40 can be attached to the plow 10 within a guide track 44 that is positioned along the top end 15*c* of the plow 10. The track 44 also includes a first biasing member 46 located within the track 44 and attached between one end of the track 44 and the ball 41. The first biasing member 46 can be a spring, a block of elastic material, or any other suitable resilient member, and urges the ball 41 and brace 40 along the track 44 towards the barrier 18. When the base 20 is lowered to the extended position, the first biasing member 46 forces the ball 41 along the track 44 so that the position of the brace 40 on the plow 10 shifts to accommodate the extension of the base 20. Also, because the first biasing member 46 is in a stretched condition when the barrier 18 and brace 40 are in the extended position, when the barrier 18 is moved to the retracted position, the first biasing member 46 assists in the return movement of the ball 41 within the track 44 until the ball 41 compresses the first biasing member 46 within the track 44, preparing for the next deployment of the barrier 18.

This particular embodiment of the brace 40 to the plow 10 allows the brace 40 to compensate for the movement of the base 20 between the deployed position and retracted position similarly to the previous embodiment. Also, the first biasing member 46 provides a shock-absorbing capacity for the barrier 18 similar to the gas spring mechanism to lessen the wear and tear on the barrier 18 when the base 20 impacts against a rigid object in the deployed position.

The shock-absorbing capability of this embodiment of the brace 40, or any other embodiment for the brace 40, can be enhanced by providing a second biasing member 48 on the brace 40. The second biasing member 48 is positioned between and connects an upper part 50 and a lower part 52 of the brace 40 located on each side of the second biasing member 48. When the barrier 18 is in use, the compression and/or expansion of the second member 48 when the base 20 strikes an object allows the barrier 18 to absorb the shock and reduce or avoid damage to the barrier 18.

Figure 9:
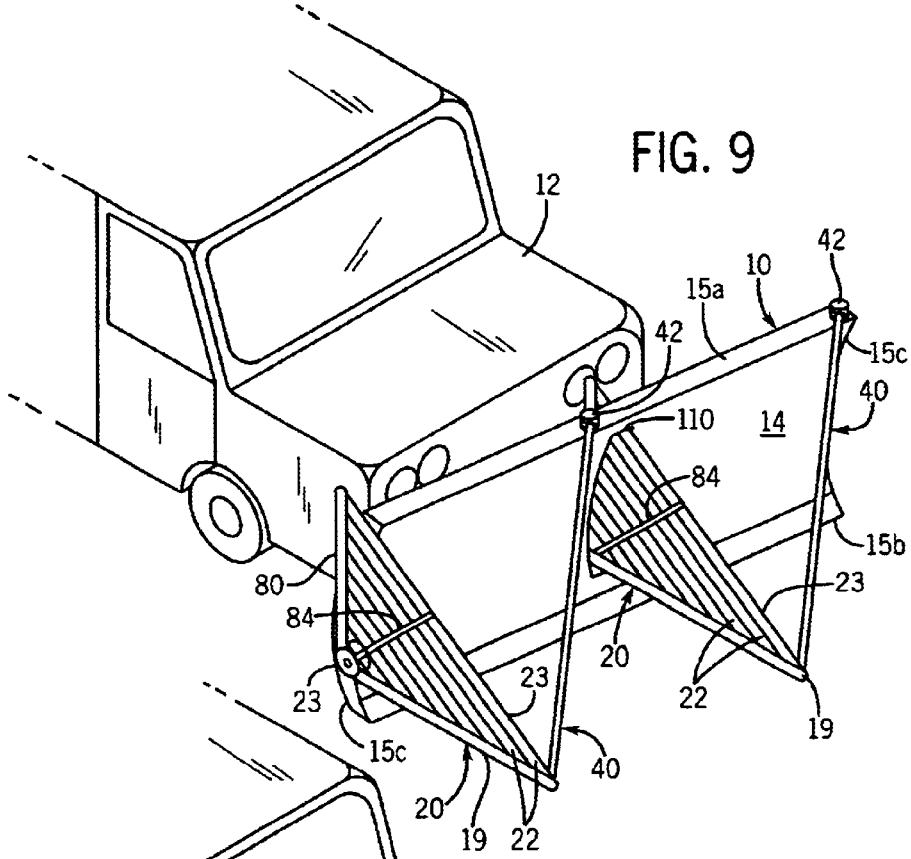
FIG. 9 is an isometric view of the snow plow blade of FIG. 1 including a second barrier attachment extending through a slot in the blade.

In still a third embodiment for the brace 40 shown in FIG. 9, the barrier attachment 18 is positioned along one side 15*c* of the plow 10, and a second barrier attachment 18' is disposed between the first barrier attachment 18 and the opposite side 15*c* of the plow 10. The first barrier attachment 18 is disposed against one side 15*c* of the front surface 14 such that the flexible members 22 extend around the side 15*c* of the plow 10 from the front surface 14 to the rear surface 16. The base 20 of the adjacent second barrier attachment 18' is positioned directly beneath a slot 110 cut into the front surface 14 of the plow 10 that enables the flexible members 22 associated with the second barrier 19 to extend through the slot 110 to the associated winding mechanism 24 disposed on the rear surface 16 of the plow 10. Furthermore, in this embodiment, the barriers attachments 18 and 18' can be operated either simultaneously or can be operated independently of one another such that the desired configuration for the plow 10 can be created by the selective deployment of the barrier attachments 18 and 18'.

Figure 10:
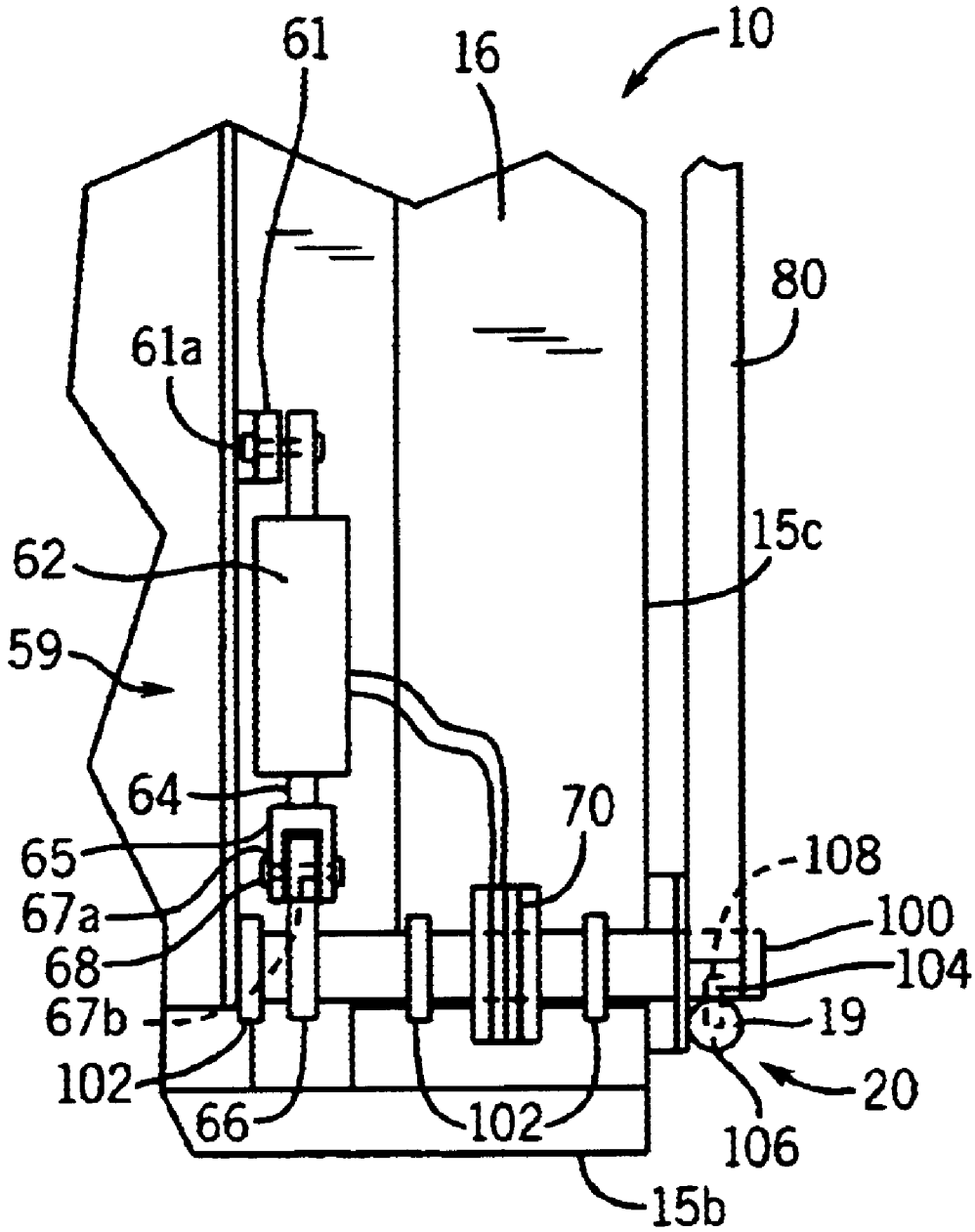
FIG. 10 is a partially broken away rear view of a deployment mechanism for the barrier of FIG. 9.

Each of the barriers 18 and 18' includes a brace 40 formed of a single piece of a rigid material and pivotally mounted at each end to the top end 15*c* of the plow 10 and to the base 20 opposite the plow 10, as described previously. However, since the brace 40 does not includes any means for compensating for the overall length of the brace 40, the flanges 23 are removed and the arm 19 of the base 20 is pivotally secured to the shaft 100 to pivot along an axis parallel to the sides 15*c* of the plow 10. As shown in FIG. 10, the base 20 includes a pin 104 inserted through a bore 106 disposed in the end of the base 20 and perpendicularly intersecting the shaft opening 103. The pin 104 extends through a channel 108 passing through the shaft 100 and aligned with the bore 106. The base 20 can pivot with respect to the shaft 100 about the pin 104 such that, in the retracted position, the base 20 can angle outwardly from the side 15*c* of the plow blade 10 to accommodate the entire length of the brace 40.

In addition to these preferred embodiments, the brace 40 can be formed from a number of other types of structures, such as telescoping tubes, a chain, a retractable cable, or other suitable structure that provides the necessary amount of support against the pivoting movement of the barrier 18 away from the plow blade 10. In addition to the biasing members 46 and 48 that can be used with the various embodiments for the brace 40, the base 20 can include a wear bar 54 mounted to the base 20 below the flexible members 22 as shown in FIGS. 3 and 4. The wear bar 54 is formed of a rigid, wear-resistant material, such as a heavy metal, with a sloped forward end 55 and is secured to the base 20 by a number of springs 56 or other suitable resilient members disposed in aligned depressions 57 in the wear bar 54 and arm 19 of the base 20. The springs 56 allow the wear bar 54 to move with respect to the base 20 when the wear bar 54 contacts an obstruction, such that the wear bar 54 and springs 56 absorb the impact from contacting the obstruction without transmitting the shock of the impact to the base 20 and the barrier 18.

Additionally, in order to prevent premature wear of the flexible members 22 and to provide a flexible member 22 with an attachment point (not shown) for the cable 84 and/or the loop 88, a leading edge 90 can be provided on the barrier attachment 18. The leading edge 90 is formed by placing a cable or chain 92 formed of a very high strength material at the front of the wall 23 to cut through snow drifts and break up any hardened pieces of snow or ice which the barrier 18 contracts during the operation of the plow 10 to minimize ice damage to the flexible member 22.

Figure 11:
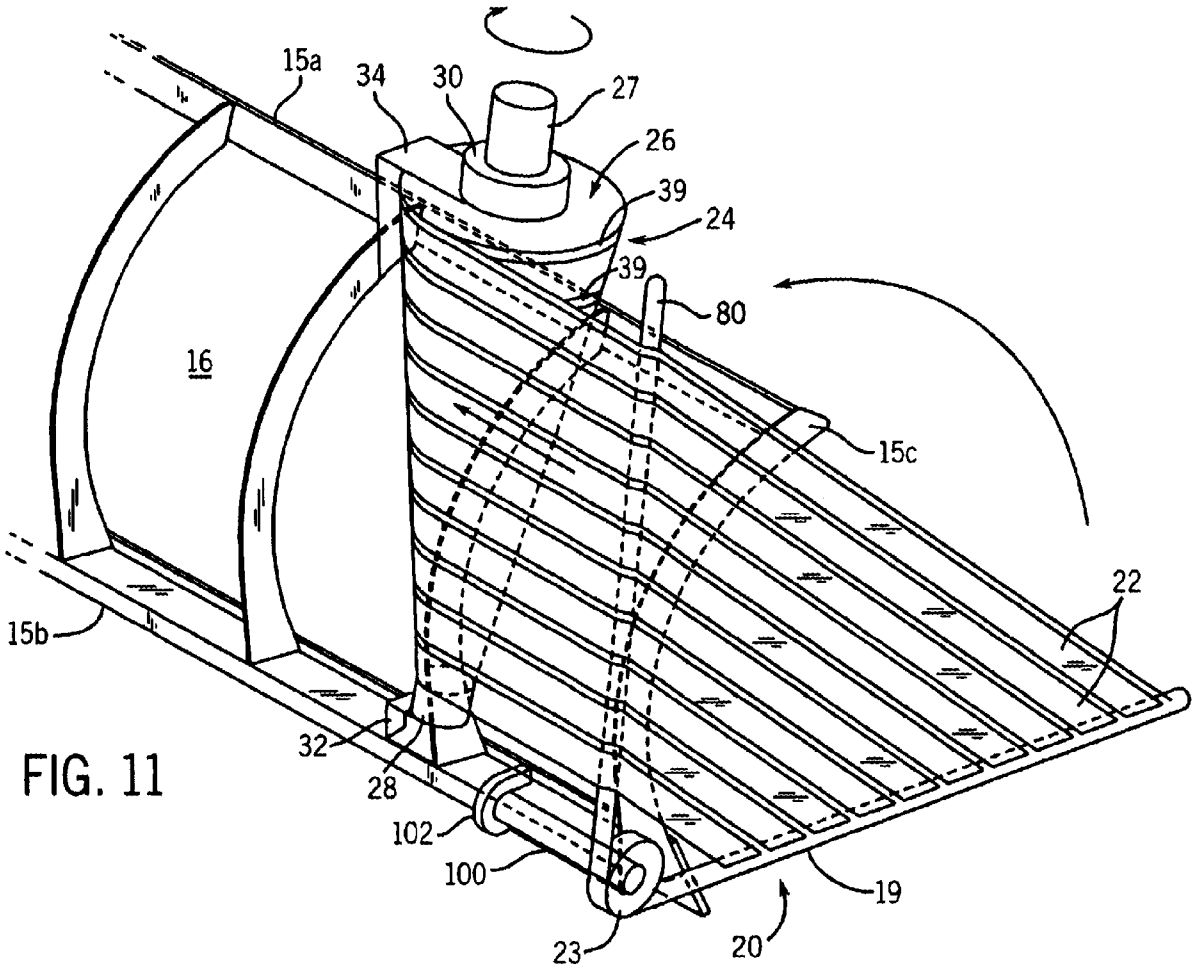
FIG. 11 is a partially broken away isometric view of a third embodiment of the barrier attachment of FIG. 1.

In a separate embodiment of the invention, the deployment mechanism 56 and the retraction mechanism 59 can be replaced by a retraction mechanism 24 shown in FIG. 11. The retraction mechanism 24 includes a conical drum 26 mounted vertically behind the plow 10 and including a shaft 27 connected between a pair of bearings 28 and 30. The drum 26 is preferably formed of a rigid material, such as a hard plastic or a metal, and can be formed as either a solid piece of the rigid material, a hollow, enclosed piece of the rigid material, or a hollow, cylindrical piece of the rigid material. The lower bearing 28 is positioned on an outwardly extending flange 32 connected to the rear surface 16 of the plow 10 slightly above the shaft 100 to support the shaft 27 and the drum 26. The upper bearing 30 is held in position by a support arm 34 extending outwardly from the rear surface 16 of the plow 10 to the upper bearing 30. Further, the shaft 27 is operably connected to a hydraulic motor (not shown) that, in turn, is operably connected to the hitch mechanism 17. The motor 36 can be operated utilizing the power of the vehicle 12 by a control system (not shown) disposed either on the plow 10 or within the vehicle 12.

The flexible members 22 are attached opposite the base 20 to the drum 26 such that the flexible member 22 disposed on the outermost portion of the base 20 is attached to the top of the drum 26 with each successive flexible member 22 being secured to the drum 26 slightly below the preceding flexible member 22. In this arrangement, when the drum 26 is rotated by the operation of the motor 36, the drum 26 winds the flexible members 22 around the various sections of the drum 26 to retract the movable barrier 18 from the deployed position shown in FIG. 11 to the retracted position where each base 20 is oriented vertically against the side 15*c* of the plow 10. Further, to ensure that the flexible members 22 are maintained around the appropriate sections of the drum 26 in order to prevent adjacent flexible members 22 from tangling with one another, the drum 26 may include a number of ridges or flights 39 disposed around the various sections of the drum 26 to maintain the flexible members 22 in the appropriate positions as they are wound and unwound from the drum 26.

Each embodiment of the barrier attachment 18 connected to the side 15*c* of the plow blade 10 is also adaptable for use as the barrier attachment 18' that extends through the slot 110 in the plow blade 10 alone or in addition to the barrier attachment 18.

Further details regarding the construction and use of the steel plow wing assembly are disclosed in the attached drawings, which are incorporated herein by reference. It is understood that the various preferred embodiments are shown and described above to illustrate different possible features of the invention and the varying ways in which these features may be combined. Apart from combining the different features of the above embodiments in varying ways, other modifications are also considered to be within the scope of the invention.

What is claimed is:

1. A snow plow comprising:

a) a concave blade adapted to be secured to a vehicle, the blade having a front surface and a rear surface and defining a top end, a bottom end and a pair of opposed sides joining the top and bottom ends;

b) a first barrier attachment secured to the blade, the first barrier attachment including:

1) a base pivotally secured to the blade;

2) a plurality of flexible members secured to the base at one end; and 3) a first retraction mechanism secured to the blade adjacent the first barrier, the first retraction mechanism connected to the number of flexible members.

2. The snow plow of claim 1 further comprising an anchor tube secured to the blade adjacent the base and connected to each of the flexible members opposite the base.

3. The snow plow of claim 2 wherein the first retraction mechanism is disposed at least partially within the anchor tube.

4. The snow plow of claim 3 wherein the first retraction mechanism comprises a biasing element fixed to the interior of the anchor tube and a pulling member attached to the biasing element at one end and to the flexible members at the opposite end.

5. The snow plow of claim 4 wherein the pulling member defines a loop opposite the biasing element that is positioned around the flexible members.

6. The snow plow of claim 1 wherein the flexible members are selected from the group consisting of: straps, cables and chains.

7. The snow plow of claim 1 wherein the flexible members are formed from the material selected from the group consisting of: metals, plastics and synthetic materials.

8. The snow plow of claim 7 wherein the flexible members are formed from nylon webbing.

9. The snow plow of claim 1 wherein the outermost flexible member is a reinforced flexible member.

10. The snow plow of claim 1 wherein the first retraction mechanism comprises a rotatable member disposed on the rear surface of the blade and connected to the flexible members opposite the base.

11. The snow plow of claim 10 wherein the rotatable member is conical in shape.

12. The snow plow of claim 11 further comprising a number of circumferential flights disposed on the rotatable member.

13. The snow plow of claim 1 wherein the first barrier attachment further comprises a first deployment mechanism including a ram secured to the blade and connectable to the vehicle, and having an extendable arm operably connected to the base.

14. The snow plow of claim 13 wherein the first deployment mechanism includes a rotatable shaft connected to the extendable arm at one end and connected to the base at the opposite end.

15. The snow plow of claim 14 further comprising a clutch connected to the shaft.

16. The snow plow of claim 1 further comprising a brace connected between the base and the blade.

17. The snow plow of claim 16 wherein the brace is pivotally connected to the blade.

18. The snow plow of claim 17 wherein the brace includes a ball at one end pivotally disposed within a socket disposed on the blade.

19. The snow plow of claim 18 wherein the socket is an elongate track including a first biasing member disposed within the track in engagement with the ball.

20. The snow plow of claim 16 wherein the brace is made of a rigid material.

21. The snow plow of claim 16 wherein the brace includes a lower part connected to the base, an upper part connected to the blade, and a second biasing member connecting the lower part and the upper part.

22. The snow plow of claim 1 further comprising a wear bar secured to the base opposite the blade.

23. The snow plow of claim 1 wherein the base is pivotally secured to one side of the blade.

24. The snow plow of claim 1 wherein the base is pivotally secured within a slot formed in the blade.

25. The snow plow of claim 1 further comprising a second barrier attachment secured to the blade and spaced from the first barrier attachment, the second barrier attachment including:

1) a base pivotally secured to the blade;

2) a plurality of flexible members secured to the base at one end; and 3) a second retraction mechanism secured to the blade adjacent the second barrier and connected to the flexible members.

26. The snow plow of claim 25 further comprising a slot in the blade through which the flexible members on the second barrier extend from the base of the second barrier to the second retraction mechanism.

27. The snow plow of claim 25 wherein the first retraction mechanism and second retraction mechanism operate independently.

28. A method for selectively discharging snow collected by a snow plow, the method comprising the steps of:

a) providing a snow plow blade including a first barrier attachment secured to the blade, the first barrier attachment including a base pivotally secured to the blade, a plurality of flexible members secured to the base at one end, and a first retraction mechanism connected to the flexible members and disposed on the blade;

b) connecting the snow plow blade to a vehicle; and c) pivoting the base of the first barrier attachment between a generally vertical retracted position and a generally horizontal deployed position on the blade.

29. The method of claim 28 wherein the step of pivoting the base of the first barrier attachment is performed by operating the first retraction mechanism.

30. The method of claim 28 wherein the first barrier attachment further comprises a first deployment mechanism disposed on the blade and operably connected to the base, and wherein the step of pivoting the base of the first barrier attachment is performed by operating the first deployment mechanism.

31. The method of claim 28 further comprising the steps of:

a) providing a second barrier attachment on the blade spaced from the first barrier attachment, the second barrier attachment having a base pivotally secured to the blade, a number of flexible members attached to the base at one end and a second retraction mechanism connected to the flexible members and disposed on the blade; and b) pivoting the base of the second barrier attachment between a deployed position and a retracted position after pivoting the base of the first barrier attachment.

32. The method of claim 31 wherein the steps of pivoting the base of the first barrier attachment and pivoting the base of the second barrier attachment occur simultaneously.

33. A barrier attachment adapted to be connected to a snow plow blade, the barrier attachment comprising:

a) a base formed of a rigid material and pivotally connectable to the blade;

b) a plurality of flexible members connected to the base at one end; and c) a retraction mechanism positionable on the blade at a location spaced from the base and connected to the flexible members.

34. The barrier of claim 33 further comprising a deployment mechanism positionable on the blade and operably connected to the base.

35. The barrier of claim 33 further comprising a brace connectable to the blade and connected to the base.

36. The barrier of claim 35 wherein the brace is pivotally connected to the base and pivotally connectable to the blade.

37. The barrier of claim 33 wherein the base is pivotally connectable to the blade to pivot in more than one direction.

38. The barrier of claim 33 wherein the base includes a wear bar secured to the base.

39. The barrier of claim 33 further comprising a leading edge connected to the base adjacent the flexible members.

* * * * *